United States Patent [19]

de Castella et al.

[11] 3,955,844

[45] May 11, 1976

[54] CRANE CABLE ATTACHMENT

[75] Inventors: Pierre M. T. de Castella, Monnaz sur Morges, Switzerland; Rene A. Fichter, Douglaston, N.Y.

[73] Assignee: Baumatic S.A., Morges, Switzerland

[22] Filed: Aug. 5, 1974

[21] Appl. No.: 494,997

[30] Foreign Application Priority Data

Aug. 7, 1973 Switzerland ..... 11425/73

[52] U.S. Cl. ..... 294/67 R; 212/9; 212/145; 294/81 R

[51] Int. Cl.[2] ..... B66C 1/00

[58] Field of Search ..... 294/67 R, 67 AA, 81 R; 214/16.4 A, 730, 95 R; 187/6, 7; 212/1, 10–27, 145

[56] References Cited

UNITED STATES PATENTS

| | | | |
|---|---|---|---|
| 3,249,236 | 5/1966 | Kummeran | 212/27 |
| 3,406,845 | 10/1968 | Fahey | 294/81 R |
| 3,848,751 | 11/1974 | Holland, Sr. | 212/56 |

*Primary Examiner*—Albert J. Makay
*Assistant Examiner*—Lawrence J. Oresky
*Attorney, Agent, or Firm*—Ostrolenk, Faber, Gerb & Sofffen

[57] ABSTRACT

A crane cable attachment for delivering and taking up loads through openings in walls and the like comprises a generally horizontal rail suspended from the crane cable. A load carrying carriage is mounted for movement along the rail, between a lifting position underneath the cable and a loading and unloading position towards one end of the rail. An elongate prop is pivotally connected to this end of the rail for movement between a position in which it may rest on the ground where a load is to be delivered or taken up and a lifting position folded under the rail. A counter-weight is provided at the other end of the rail to maintain it horizontal when both the prop and carriage are in the lifting positions.

8 Claims, 2 Drawing Figures

CRANE CABLE ATTACHMENT

The invention relates to cable attachments for use with a crane or equivalent hoisting device to deliver and take up loads through openings in walls and the like. The term crane cable as employed herein is taken to include equivalent such as chains.

Crane-cable attachments are known in the form of horizontal compensation bars formed by a rail at an end of which is provided a hook for carrying a load, a counter-weight being movably mounted along the rail to balance the assembly with the rail horizontal. These compensation bars are heavy and cumbersome and, as the load lifted is balanced by a counter-weight, it is necessary to employ a crane capable of lifting about 60% more weight than the load to be moved.

Other compensation bars including portal frames at their two ends have also been proposed, the portal frames being adapted to enable the compensation bar with the load to be posed on the ground. These types are also very cumbersome and cannot be used to pass loads through small openings, such as windows, of a building.

An aim of the invention is to remedy these drawbacks and to provide a simple compensation-bar type crane cable attachment which is of low weight and may be used to deliver and take-up loads through small openings of in the walls of buildings being constructed.

According to the invention, a crane cable attachment comprises a rail, means for suspending the rail transverse to a crane cable, a load-carrying carriage mounted for movement along the rail between a lifting position disposed in extension of a cable supporting the rail and a loading and unloading position towards one end of the rail, and an elongate prop pivotally connected to said one end of the rail for movement between a position protruding from the rail to be able to take support on a base surface where a load is to be delivered or taken up and a folded-away lifting position against and generally parallel to the rail.

In a preferred embodiment, the attachment comprises means for moving the carriage along the rail, these means being formed by a cable or chain driven by a pulley block, and the prop comprising a jack pivotally connected to the rail, the jack being operatively connected with an elongate rack provided with a foot which may rest on the ground.

The crane cable attachment according to the invention is simple to handle and can be used to deliver a load into a building through a window or similar opening of small dimensions.

The accompanying drawings show, by way of example, two embodiments of the invention. In the drawings.

Figure 1:
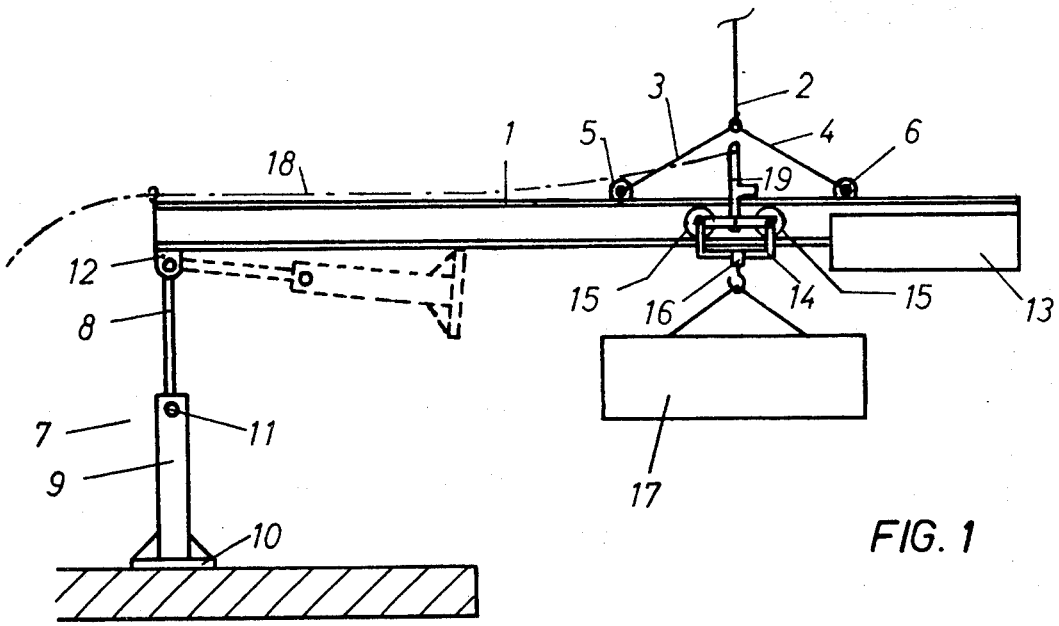
FIG. 1 is a schematic view of a first embodiment of crane cable attachment.

The crane cable attachment shown in FIG. 1 comprises an I-section rail 1 suspended from a cable 2 of a crane (not shown) by means of two chains 3 and 4 attached to rings 5 and 6 welded on the upper face of rail 1. One end of rail 1 carries an elongate prop 7 formed by a tube 8 slidably mounted in a tube 9 of greater diameter, the end of tube 9 having a foot 10 which comes to rest on the ground during posing or taking up a load. A locking means 11 is provided at the upper part of tube 9 to jam tube 8 and thus adjust the height of the prop. The upper end of tube 8 is pivotally connected to a piece 12 welded on the underneath face of rail 1 to enable the prop 7 to be folded away under rail 1, as indicated in dashed lines in FIG. 1, during lifting of the device. The other end of rail 1 supports a counter-weight 13 for balancing the assembly during lifting. The rail 1 carries a carriage 14 suspended from the lower flanges of the rail 1 by means of four rollers 15, the carriage 14 having a hook 16 for carrying a load 17. The device also comprises a cable 18, shown in dotted-dashed lines, attached to a braking device 19 on the carriage 14 which enables the carriage 14 to be stopped and held at given locations along the rail 1, in particular under the cable 2 and towards the prop 7. The braking device 19 is simply a lever-actuated member on the carriage 14 and which acts by friction against the rail to enable the carriage to be jammed at a given location.

The described device is used as follows:

Suppose that the load 17 lifted by the crane (not shown) is passed through an opening in the wall of a building to be posed on the ground or other base surface, as indicated in FIG. 1. The device is brought to this position with the rail 1 horizontal, the prop 7 folded away as shown in dashed lines in FIG. 1 and the carriage 14 carrying load 17 fixed by means of cable 18 in a position in extension of cable 2, the assembly of the attachment and the load thus being balanced. The prop 7 is folded down by a workman. As the prop 7 is lowered, its center of gravity moves towards the prop end of rail 1 so that the rail 1 tilts from the horizontal to a position slightly inclined downwardly towards the left of FIG. 1. The foot 10 of prop 7 is then brought into contact with the ground either by lowering the assembly by cable 2, or by sliding tube 9 along tube 8 and securing these tubes in place. The carriage-braking device 19 is then relaxed by means of cable 18 and as the rail 1 is slightly inclined, the carriage 14 and load 17 move by gravity to the propped end of rail 1. If the load 17 does not contact the ground, the locking means 11 of prop 7 is released and, with a sliding of the tubes, the rail 1 is lowered to pose and unhook the load 17.

To pick-up a load, there are two possibilities. In the first, the load is attached to hook 16 while the carriage 14 is disposed under the cable 2, in the case where the load is picked up from an unobstructed location outside a building. The carriage 14 is thus simply brought to its position under cable 2 and locked in this position by means of cable 18. The load is then hooked on and, with the prop 7 folded away, the assembly can be lifted up by the crane.

In the second case, suppose that a load must be picked up from inside a building through an opening such as a window. In this case, it is not possible to directly hook on the load with the carriage 14 already in its lifting position, i.e. in extension of cable 2. THe prop-carrying arm of rail 1 is firstly passed through the opening in the building and the foot 10 of prop 7 placed on the ground. The carriage 14 is then moved along towards the propped end of rail 1 and is locked in position. The load is hooked on and the cable 2 then lowered to incline the rail 1 with its right-hand end downwards and with its left hand end still supported by the prop 7. The carriage 14 and load 17 can then be moved by gravity towards the right, and the carriage is locked under cable 2 by means of cable 18. The assembly can then be lifted and prop 7 folded away against rail 1.

The total weight that can be lifted by the described device depends of course on the lifting system or crane used. A production model of the device could for example be conceived to lift a load of two tons and would have a total weight, with the load, of two and a half tons. The length of the rail could be 4.5 to 6 metres and would enable a penetration of from 3 to 4 metres in a building. The penetration of a device of this type is the overall path of movement of the carriage, this path being practically equal to the distance between the prop-carrying end of the rail and the effective point of attachment of cable 2.

The embodiment of FIG. 1 is previewed for moving the carriage 14 and load by gravity, i.e. by inclining the rail. To this end, it was necessary to be able to lock the carriage in the balanced position of the assembly under the carrying cable. A control cable was thus provided for this purpose.

It is however evident that the carriage may be moved not by gravity, but by mechanical means. For example, a battery-operated electric motor could drive the carriage by means of a rack provided along the rail, the motor and battery being housed in the carriage. In this case, it would suffice to provide a motor control switch near the prop-carrying end of the rail. The motor and battery could alternatively be placed in the counter-weight, and drive the carriage by means of a cable or an endless chain.

Adjustment of the height of the prop could also be provided by hydraulic means including a cylinder, a piston slidably mounted in the cylinder, and a valve controlling the introduction of liquid in the cylinder to adjust the height of the prop.

Figure 2:
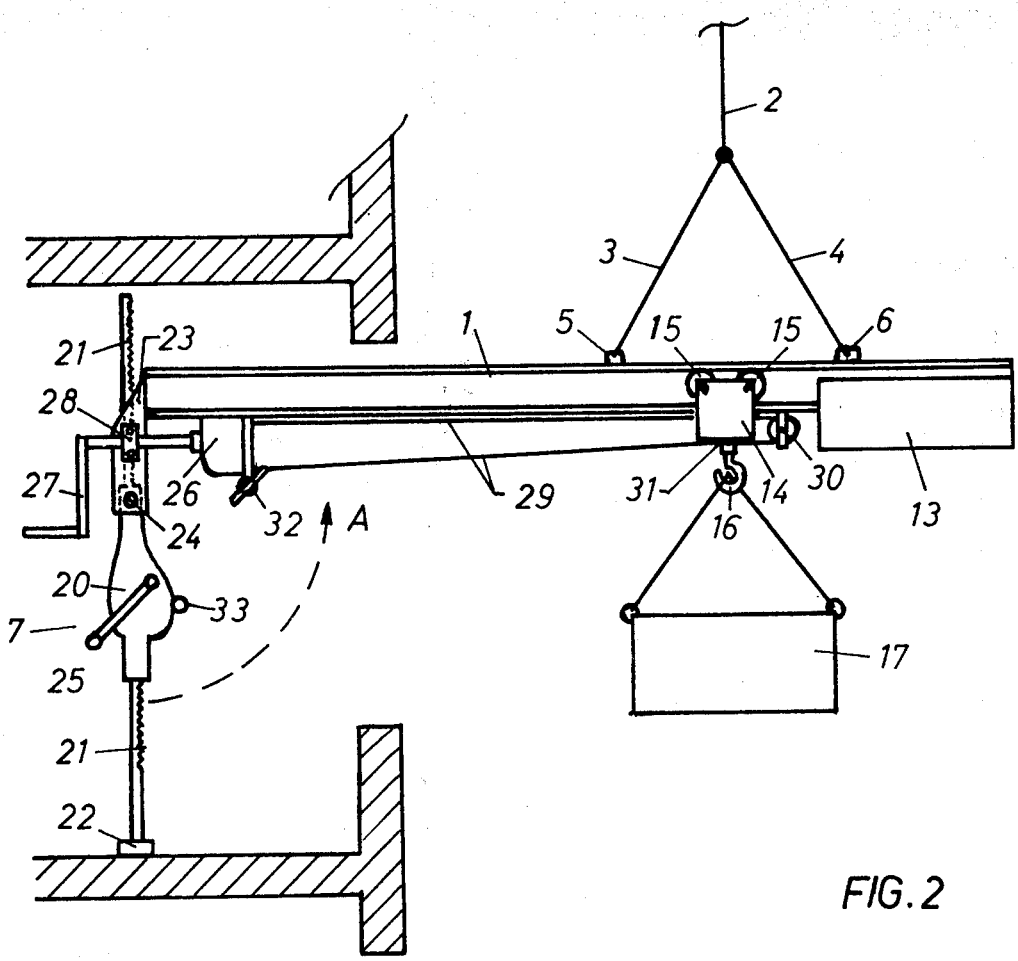
FIG. 2 is a schematic view of a more elaborate second embodiment of crane cable attachment.

The preferred embodiment of FIG. 2 also comprises and I-section rail 1 suspended from a cable 2 of a crane (not shown) by means of two chains 3 and 4 attached to rings 5 and 6 welded on the upper face of rail 1. One end of rail 1 carries a prop 7 whereas the other end carries a counter-weight to balance the assembly. On the rail 1 is mounted a carriage 14 resting on the two lower flanges of the rail by means of four rollers 15. The lower part of carriage 14 has a hook 16 for supporting a load 17. The prop 7 includes a jack 20 through which passes an elongate rack 21 whose lower end has a foot 22 resting on a floor, as shown. The jack 20 is pivotally connected to a piece 23 perpendicular to rail 1 by means of a pin 24, whereby it can be pivoted as indicated by arrow A to a folded-away position under and generally parallel to the rail 1. The piece 23 is a U-shaped section of which the central web is welded to the rail 1 whereby the upper end part of the rack 21 may extend beyond piece 23 when the prop is folded away under the rail 1. The jack 20 includes a crank handle 25 enabling raising and lowering of the propped end of rail 1 relative to the rack 21 which is placed upright on the floor. Under the rail 1 in the proximity of prop 7 is secured a pulley block 26 controlled by a crank handle 27 held against piece 23 by a bearing 28. The pulley block 26 drives an endless chain 29 passing about a wheel 30 disposed at the other end of rail 1 in the proximity of counter-weight 13. The upper run of endless chain 29 passes freely through carriage 14 and its lower run, passing under the carriage 14, is secured at 31 to the carriage 14 so as to drive carriage along the rail 1 when crank handle 27 is turned in either direction. On the casing of pulley block 26 is provided a catch 32 which engages in a ring 33 welded on jack 20 to hold the jack in the folded-away lifting position parallel to rail 1.

The second embodiment of device is used as follows:

Suppose that the load 17 must be lifted from the open ground to be delivered via a window opening onto the floor of a building in construction. The carriage 14 is brought to its lifting position under the cable 2 of the crane (not shown) by means of crank handle 27. The crutch 7 is placed in its folded-away lifting position disposed under and parallel to rail 1. The load 17 is attached to hook 16 and lifted up, and the prop-carrying arm of rail 1 is introduced through the window opening, as shown in FIG. 2. The prop 7 is lowered and the end of rail 1 lowered or raised by means of jack 20 to enable the load 17 to pass through the window opening. The load 17 is then moved along close to the prop 7 by means of the pulley block 26 by turning the crank handle 27 in the appropriate direction. The propped end of rail 1 inside the building is then lowered by means of jack 20 until the load 17 comes into contact with the floor. The load 17 may then be unhooked, the carriage 14 returned to its lifting position, the prop 7 folded away under rail 1, and the assembly moved away out of the opening to pick up another load.

In the event where a load is to be lowered onto the ground from inside an upper storey of a building, the prop-carrying end of rail 1 is passed through a window or similar opening in the building, with the prop 7 folded away and the carriage 14 under cable 2. The prop 7 is then folded down into contact with the floor and the end of rail 1 is lowered by means of jack 20 until the load 17 can be hooked on, after having moved the carriage 14 close to prop 7 by means of the pulley block 26. Once the load is hooked on, the propped end of rail 1 is raised by jack 20, until the load 17 can pass through the opening, and the carriage 14 is moved back under cable 2. The prop 7 is folded under rail 1, and the assembly then lifted away.

The device described with reference to FIG. 2, as that described with reference to FIG. 1, may include motors for moving the carriage 14 and for raising and lowering the propped end of the rail 1 penetrating through the opening of the building. Also, it is possible to provide electric lamps controlled by switches near the prop 7 to enable signals to be given to the crane operator. These and similar variations can be readily carried out by persons skilled in the art.

The embodiment of FIG. 2 has various advantages:

in the lifting position, with the load disposed under the crane cable and the prop folded away parallel to the rail, it takes up little place and can be introduced in openings, such as window openings, of small dimensions. It suffices to suspend the load in a manner to offer a reduced bulk to enable the load to be passed through window openings of normal dimensions.

the rack 21 can have a length corresponding approximately to the height of one storey of a building. There is thus a great liberty of movement, and the rail can be positioned at the desired height during posing or taking up of a load.

the device is simple to handle and the control of the raising and lowering of the height of the prop and movement of the carriage are reliable and easily controlled, even in the event where the rail or the prop is not correctly positioned during unloading or loading, for example with the rail non horizontal. Accidents due to sliding of the carriage or dropping of loads are thus avoided.

in the case where the rack is long enough for use in building constructions having storeys exceeding the normal height, it is possible to place the pulley block 26 with its crank handle 27 on the prop, the chain 29 turning about wheels disposed about the pivoting axis of pin 24. In this manner, the crank controlling movement of the carriage 14 is always accessible to a user even if the rack 21 has a height of three or four metres.

apart from the relatively small counter-weight 13 for balancing the weight of prop 7 and the weight of the additional length of the longer part of the rail from the effective point of suspension, the crane supports no supplementary counter balancing weights such as those for balancing the loads in the case of prior art devices, so that practically all of the lifting capacity of the crane may be used for lifting the load.

What is claimed is:

1. A crane cable attachment comprising a rail, means for suspending the rail transverse to a crane cable, a load-carrying carriage mounted for movement along the rail between a lifting position disposed in extension of a cable supporting the rail and a loading and unloading position towards one end of the rail, and an elongate prop pivotally connected to said one end of the rail for movement between a position protruding from the rail to be able to take support on a base surface where a load is to be delivered or taken up and a folded-away lifting position against and generally parallel to the rail; means for selectively elongating and shortening said prop, particularly during loading and unloading said carriage.

2. A crane cable attachment as claimed in claim 1, comprising means for retaining and holding the carriage in at least one predetermined location along the rail.

3. A crane cable attachment as claimed in claim 1, comprising means for moving the carriage along the rail.

4. A crane cable attachment as claimed in claim 3, in which said moving means comprise a cable or chain driven by a pulley block.

5. A crane cable attachment as claimed in claim 1, comprising a counter-weight for maintaining the the suspended rail horizontal when both the carriage and the prop are in the lifting position.

6. A crane cable attachment comprising a rail, means for suspending the rail transverse to a crane cable, a load-carrying carriage mounted for movement along the rail between a lifting position disposed in extension of a cable supporting the rail and a loading and unloading position towards one end of the rail, and an elongate prop pivotally connected to said one end of the rail for movement between a position protruding from the rail to be able to take support on a base surface where a load is to be delivered or taken up and a folded-away lifting position against and generally parallel to the rail; said prop comprising two tubes slidably mounted in one another, and means for locking the tubes in selected positions to adjust the height of the prop.

7. A crane cable attachment comprising a rail, means for suspending the rail transverse to a crane cable, a load-carrying carriage mounted for movement along the rail between a lifting position disposed in extension of a cable supporting the rail and a loading and unloading position towards one end of the rail, and an elongate prop pivotally connected to said one end of the rail for movement between a position protruding from the rail to be able to take support on a base surface where a load is to be delivered or taken up and a folded-away lifting position against and generally paralle to the rail; said prop comprising a jack pivotally connected to the rail, the jack being operatively connected with an elongate rack provided with a foot.

8. A crane cable attachment comprising a rail, means for suspending the rail transverse to a crane cable, a load-carrying carriage mounted for movement along the rail between a lifting position disposed in extension of a cable supporting the rail and a loading and unloading position towards one end of the rail, and an elongate prop pivotally connected to said one end of the rail for movement between a position protruding from the rail to be able to take support on a base surface where a load is to be delivered or taken up and a folded-away lifting position against and generally parallel to the rail; said prop comprising a hydraulic cylinder, a piston slidably mounted in the cylinder, and a valve controlling the introduction of liquid in the cylinder to adjust the height of the prop.

* * * * *